United States Patent [19]

Derr, Jr. et al.

[11] Patent Number: 4,780,193

[45] Date of Patent: Oct. 25, 1988

[54] PROCESS FOR HYDROTREATING CATALYTIC CRACKING FEEDSTOCKS

[75] Inventors: W. Rodman Derr, Jr., Vincentown; Robert E. Holland, Mullica Hill; Stephen J. McGovern, Mantua; William J. Tracy, III, Sewell, all of N.J.

[73] Assignee: Mobil Oil Corporation, New York, N.Y.

[21] Appl. No.: 945,254

[22] Filed: Dec. 22, 1986

[51] Int. Cl.[4] ..... C10G 69/04

[52] U.S. Cl. ..... 208/89; 208/57; 208/61; 208/144; 208/254 H

[58] Field of Search ..... 208/89, 57, 58, 61, 208/120, 254 H, 144

[56] References Cited

U.S. PATENT DOCUMENTS

| | | | |
|---|---|---|---|
| 3,852,187 | 12/1974 | Christman et al. | 208/61 |
| 3,860,510 | 1/1975 | Henke et al. | 208/61 |
| 4,025,417 | 5/1977 | Pavlica | 208/57 |
| 4,067,798 | 1/1978 | Hauschildt et al. | 208/61 |
| 4,267,033 | 5/1981 | Heck et al. | 208/216 |
| 4,357,263 | 11/1982 | Heck et al. | 252/439 |
| 4,419,218 | 12/1983 | Angevine et al. | 208/89 |
| 4,430,198 | 2/1984 | Heck et al. | 208/112 |
| 4,442,023 | 4/1984 | Heck et al. | 502/222 |
| 4,521,297 | 6/1985 | Angevine et al. | 208/89 |
| 4,534,852 | 8/1985 | Washecheck et al. | 208/89 |
| 4,540,481 | 9/1985 | Sawyer et al. | 208/215 |
| 4,540,482 | 9/1985 | Seiver et al. | 208/215 |
| 4,542,121 | 9/1985 | Mitchell, III et al. | 502/220 |
| 4,544,481 | 10/1985 | Seiver et al. | 208/215 |
| 4,565,620 | 1/1986 | Montgomery et al. | 208/57 |
| 4,620,920 | 11/1986 | van Der Eijk et al. | 208/89 |

OTHER PUBLICATIONS

"HDT and FCC Route Could Reduce US Dependence on Foreign Crude", D. Milstein et al., The Oil and Gas Journal, Jul. 19, 1976, pp. 138–141.

"Feed Hydrotreating Improves FCCU Performance", D. C. McCulloch, The Oil and Gas Journal, Jul. 21, 1975, pp. 53–58.

"Hydrotreating FCC Feed Could Be Profitable", R. E. Ritter et al., The Oil and Gas Journal, Oct. 14, 1974, pp. 99–101.

"Hydrocracking vs. Cat Cracking for Gas Oils in Today's Refineries", J. R. Murphy et al., The Oil and Gas Journal, Jun. 8, 1970, pp. 108–112.

"Hydrotreat Cat-Cracker Feedstocks for Attractive Economic Benefits", W. F. Arey, Jr. et al., The Oil and Gas Journal, pp. 131–139.

*Primary Examiner*—Anthony McFarlane

*Attorney, Agent, or Firm*—Alexander J. McKillop; Michael G. Gilman; Malcolm D. Keen

[57] ABSTRACT

Catalytic cracking of hydrocarbon feedstocks is improved by hydrotreating the cracking feed under conditions of relatively low temperature, typically below 390° C. for start-of-cycle, and high pressure, typically above 10,000 kPa, preferably above 12,000 kPa. The use of these conditions favors aromatics saturation to produce a cracking feed of improved crackability so that higher conversion is achieved in the cracking step at constant cracking conditions with production of naphtha of good octane quality. At the same time, desulfurization is achieved to maintain cracker $SO_x$ emissions at required levels; the advantages of high pressure operation are more notable at high denitrogenation severities while still achieving a low catalyst aging rate.

4 Claims, 3 Drawing Sheets

PROCESS FOR HYDROTREATING CATALYTIC CRACKING FEEDSTOCKS

FIELD OF THE INVENTION

This invention relates to the catalytic cracking of petroleum oils and more particularly, to a process for improving catalytic cracking processes by hydrotreating the feedstock.

BACKGROUND OF THE INVENTION

Catalytic cracking is an established and widely used process in the petroleum refining industry for converting oils and residua of relatively high boiling point to more valuable lower boiling products including gasoline and middle distillates such as kerosene, jet fuel and heating oil. The pre-eminent catalytic cracking process now in use is the fluid catalytic process (FCC) in which the pre-heated feed is brought into contact with a hot cracking catalyst which is in the form of a fine powder, typically with a particle size of 10–300 microns, usually about 100 microns, for the desired cracking reactions to take place. During the cracking, coke is deposited on the catalyst and this results in a loss of activity and selectivity. The coke is removed by continuously removing the coked, spent catalyst from the cracking reactor and oxidatively regenerating it by contacting it with air in a regenerator. The combustion of the coke is a strongly exothermic reaction which, besides removing the coke, serves to heat the catalyst to the temperatures appropriate for the endothermic cracking reaction. The process is carried out in an integrated unit comprising the cracking reactor, the regenerator and the appropriate ancillary equipment. The catalyst is continuously circulated from reactor to regenerator and back to the reactor with the circulation rate being adjusted relative to the feed rate of the oil to maintain a heat balanced operation in which the heat produced in the regenerator is sufficient for maintaining the cracking with the circulating, regenerated catalyst being used as the heat transfer medium. Typical fluid catalytic cracking processes are described in the monograph Fluid Catalytic Cracking with Zeolite Catalysts, Venuto, P. B. and Habib, E. T., Marcel Dekker Inc., N.Y. 1979, to which reference is made for a description of such processes. As described in the monograph, the catalysts which are currently used are based on zeolites, especially the large pore synthetic faujasites, zeolites X and Y, which have generally replaced the less active, less selective amorphous and clay catalysts formerly used.

Another catalytic cracking process still used in the industry is the moving, gravitating bed process, one form of which is known as Thermofor Catalytic Cracking (TCC) which operates in a similar manner to FCC but with a downwardly moving gravitating bed of a bead type catalyst, typically about 3–10 mm in diameter. Fixed bed units have now been replaced by moving or fluidized bed units of the FCC or TCC type.

The feed to the catalytic cracker can generally be characterized as a high boiling oil or residuum, either on its own or mixed with other fractions, usually of a high boiling point. The most common feeds are gas oils, that is, high boiling, non-residual oils with an initial boiling point usually above about 230° C. (about 450° F.), more commonly above about 345° C. (about 650° F.), with end points of up to about 620° C. (about 1150° F.). Typical gas oil feeds include straight run (atmospheric) gas oil, vacuum gas oil and coker gas oil; residual feeds include atmospheric residua, vacuum residua and residual fractions from other refining processes. Oils from synthetic sources such as Fischer-Tropsch synthesis, coal liquefaction shale oil or other synthetic processes may also yield high boiling fractions which may be catalytically cracked either on their own or in admixture with oils of petroleum origin.

The ease with which any given cracking feed is cracked and the selectivity for the desired products depends partly upon the composition of the feed. Virgin petroleum stocks which have not previously been subjected to cracking tend to crack relatively easily because they possess long chain alkyl groups which, by a process of dealkylation which occur readily during cracking, form lower boiling products. The aromatic residues which are left following dealkylation are more highly refractory so that catalytic cracking cycle oils, e.g. LCO or HCO, generally require severe hydrotreating to saturate them before they can be cracked to any significant extent under conventional conditions. Besides improving crackability, especially of these highly aromatic cycle oils, hydrotreating has been recognized as useful for other purposes, including demetallation and, above all for desulfurization and denitrogenation, both of which are desirable to improve product quality, catalyst selectivity and aging rate as well as reducing emissions, principally $SO_x$, from the regenerator. Use of a feed hydrotreater has been reported to result in higher conversion and gasoline yield, lower coke make per pass, more favorable light gas distribution, higher isobutane yield, and lower contaminant content in products and unit off-gases: cf. the Venuto/Habib monograph and the *Oil and Gas Journal*, May 19, 1966, 131–139; Oct. 14, 1974, 99–110; July 21, 1975, 53–58.

In general, the hydrotreating of catalytic cracking feedstocks has been carried out at relatively low pressures, below about 7000 kPa (about 1,000 psig) and in most cases below about 5,500 kPa (about 785 psig) as the use of higher pressures does not enhance the desulfurization activity which has, for the most part, been the principal objective of cracking feed hydrotreating. Denitrogenation has generally followed with the desulfurization to some degree, depending upon the composition of the feed and the severity of the processing although more severe processing conditions are required for nitrogen removal than sulfur removal. The hydrogenation of aromatics is known to be favored by the use of higher hydrogen partial pressures although the response of aromatic compounds differs according to their composition: condensed ring aromatics may be hydrogenated at lower pressures than non-condensed, polycyclic aromatics and although the hydrogenation of both is favored by the use of relatively low temperatures (since hydrogenation is an exothermic reaction) the optimum temperature for hydrogenating each of these types varies (*Oil and Gas Journal* July 21, 75, 53–58). The use of lower temperatures, however, does not favor sulfur or nitrogen removal because those reactions require a certain measure of cracking (an endothermic reaction) and the same is true of demetallation although, in most cases, a relatively mild treatment will suffice for metals removal. The choice of conditions for the hydrotreating of catalytic cracking feeds has therefore represented a compromise between different competing factors without a significant attempt at optimizing the conditions in a way which permits the greatest advantages to be obtained at minimum cost. In the case of hydrotreating, minimum cost implies minimum hydrogen consumption and maximum catalyst cycle life.

SUMMARY OF THE INVENTION

We have now found that the hydrotreating of catalytic feeds may be optimized in an unexpected manner which permits the cracking operation to be operated under more favorable conditions with better product quality and reduced coke make and which, moreover, enables hydrogen consumption in the hydrotreating step to be minimized without adversely affecting the catalyst aging rate. At the same time, sulfur and nitrogen removal take place readily so as to ensure satisfactorily low contaminant level in the products and a low level of pollutants in the emissions, particularly of $SO_x$, from the cracking unit.

The basis of the present invention is our finding that in the hydrotreating of catalytic cracking feeds, the saturation of aromatics is more important than nitrogen removal and that if conversion, i.e. bulk conversion to lower boiling products, in the hydrotreater is minimized, the hydrogenation of cracking fragments will be correspondingly reduced. This, in turn, will result in a lower hydrogen consumption, most of which will be represented by a reduction in the quantity of hydrogen-rich dry gas produced during the hydrotreating step. Thus, by operating under appropriate conditions, the hydrogen is used more efficiently—to increase aromatic saturation without increasing dry gas production—and this enables the cracking operation to be carried out under more favorable conditions with improved product quality and distribution.

As will be explained in greater detail below, the present catalytic cracking feed hydrotreating process is carried out under conditions which may generally be characterized as those of high pressure, low temperature and low severity with limited conversion of not more than 20 volume percent. Pressures are typically above about 10,000 kPa (about 1435 psig) and preferably above about 11,000 kPa (about 1,580 psig). Temperatures, as indicated by the start-of-cycle (SOC) temperature are typically below about 390° C. (about 734° F.) and preferably below 365° C. (about 690° F.). At these low temperatures, space velocity (LHSV) may be relatively low, typically at about 1 $hr^{-1}$ or even less; although desulfurization would proceed at higher space velocities, typically up to 2 $hr^{-1}$, catalyst aging would be accelerated so that, in general, space velocity will be below 2 and in most cases below 1.5. End of cycle (EOC) temperatures are generally to be limited to 425° F. (800° F.) and preferably, 415° C. (780° F.).

THE DRAWING

DETAILED DESCRIPTION

Figure 1A:
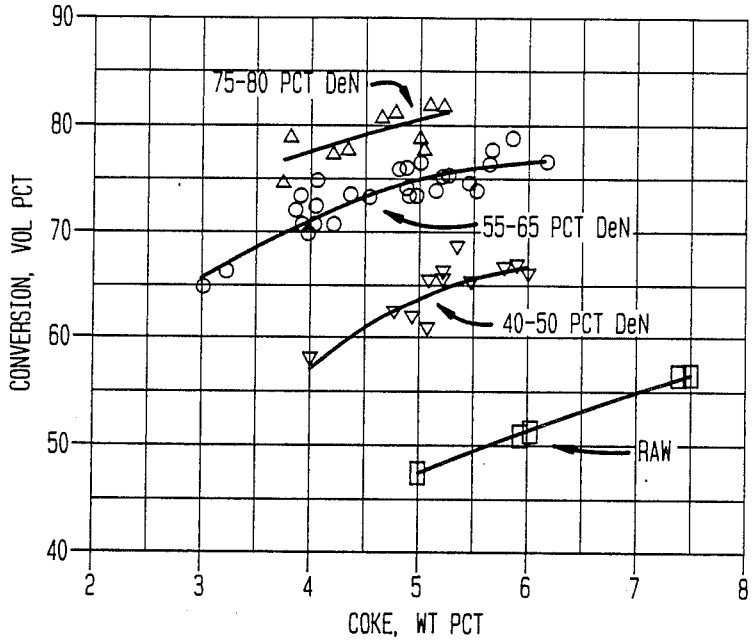
FIG. 1A is a graph relating the effect of hydrotreating severity on coke make during cracking and on cracking conversion.

The present process provides for improvements in the catalytic cracking of hydrocarbon feeds such as those conventionally subjected to catalytic cracking processes, e.g. gas oils, long and short resids, and other high boiling fractions such as those previously described. However, the process is primarily applicable to non-residual feeds since it is with these that the optimal results are obtained. Generally, the feed will have an initial boiling point of at least 205° C. (about 400° F.), more usually at least 315° C. (about 600° F.) and in most cases at least 345° C. (about 650° F.). End points will depend upon other processing constraints, particularly the ability to handle the residual fractions left after removing high end point distillates. Generally, end points will be from 510° C. (about 950° F.) to 565° C. (about 1,050° F.) although lower and higher values may be encountered.

The high boiling feeds which are to be subjected to catalytic cracking are generally characterized by a relatively high content of aromatic components including polycyclic aromatics and fused ring aromatics together with paraffins, napthenes and heterocyclics, the relative proportions of each being dependent on the origin of the feed and its previous processing history. Napthenes will most be dicyclo- and tricyclo-paraffins, especially at higher boiling points and the proportion of dinuclear and polynuclear aromatics will also increase with increasing boiling point. The paraffin content is generally less than 30 volume percent so that aromatics and napthenes will together constitute at least 70 volume percent of the feed, with the majority of this being aromatics. A number of contaminants will also be present, principally sulfur, nitrogen, oxygen and metallic impurities in amounts dependent upon the source of the feed. In general, sulfur will be present in amounts from about 0.1 to 3 weight percent although very heavy crudes, e.g. Boscan (Venezuela) may yield feeds which may be as high as about 5 weight percent sulfur. Nitrogen will generally be present in amounts from 0.05–0.5 weight percent (500–5000 ppmw) although some synthetic feeds such as shale oils may have higher contents. A number of different metals may be present, including sodium and heavier metals, of which the most significant from the view of the catalytic cracking process are nickel and vanadium since they exert the greatest deactivating effects on the cracking process. Combined nickel and vanadium contents will generally be from about 5 to 1,000 ppmw, with many being from 20 to 100 ppmw, according to source. Various formulae have been developed to express the metals content of the feed in a single figure, weighting the content of each of the metals present according to its deactiving effect on the cracking catalyst. For example, refer to the nickel equivalent formula of *Oil and Gas Journal* Oct. 23, 1961, 143 where $$\text{Nickel equivalents} = \text{Ni} + \frac{\text{V}}{4.8} + \frac{\text{Fe}}{7.1} + \frac{\text{Cu}}{1.23}$$

(see also U.S. Patent No. 4,376,038).

These contaminants should desirably be reduced to low levels prior to the catalytic cracking operation not only becuase they may adversely affect the functioning of the cracking catalyst but also because they may enter the cracked products or be emitted as a pollutant from the cracking process. e.g. $SO_x$ from the regenerator stack. Metals, especially nickel and vanadium, should be reduced to a low level, usually below 10 ppmw nickel equivalents, preferably below 1 or 2 ppmw nickel equivalents. Various methods exist for doing this. For example, sodium may be removed by a desalter and metals may be removed by coking but another method commonly used is hydroprocessing over a catalyst, as described above. This is the method employed in the present process. Generally, the conditions may be described as being elevated temperature and pressure with a catalyst which combines acidic and hydrogenation functionality. The present process departs from prior practice, however, in its careful selection of conditions so as to favor desulfurization and denitrogenation while, at the same time promoting aromatics saturation. Although nitrogen is known to affect the cracking process adversely it has been found, surprisingly, that aromatics saturation was more important than nitrogen removal and that it was possible to obtain better operation of the cracking step as aromatics saturation increased. Although hydrogen consumption is increased by the aromatics saturation which is achieved at the high pressures employed in the process, the benefits achieved are more than sufficient to outweigh the added costs provided that the conditions are controlled so as to maintain the desired reaction equilibria.

In general, the conditions used in the present process may be characterized as being of low temperature, high pressure, low space velocity and low conversion. Because one objective of the process is to saturate aromatics at the expense of denitrogenation, conversion is to be limited because under more severe conditions, hydrogen does not go into the aromatics as efficiently (the term "conversion" is used here in its specialized sense to mean a bulk conversion, that is, a conversion to lower boiling components). Based on the discovery that suitable choice of reaction conditions can lead to increased aromatics saturation without, at the same time, correspondingly increased nitrogen removal, the process can be optimized so as to improve the processing in the cracking step at minimum cost. The production of distillate in the hydrotreating step is minimized, i.e. conversion to lower boiling products is maintained at a low level so that the hydrogen which is added during the hydrotreating is, for the most part, carried over to the subsequent cracking step in order to facilitate the operation of the cracking unit. If conversion during the hydrotreating exceeds desirable values not only is valuable hydrogen lost in the form of dry gas but also as hydrogen-rich naphtha and distillate, so that the cracking step operates on a relatively hydrogen-deficient feed, with consequent deterioration in its operation: coke make increases and gasoline selectivity decreases. The production of low boiling distillates in the hydrotreating step is also undesirable because the naphtha product, being straight chain paraffinic, is low in octane. Thus, the maximum total conversion, i.e. conversion in the hydrotreating and cracking steps combined, is obtained by minimizing conversion in the hydrotreating step so as to obtain the most favorable, selective conversion in the cracking step. For any given feed, there is an optimum in hydrogen consumption which varies according to the composition of the feed. Thus, for any selected feed, the optimum hydrotreating conditions (to maximize hydrogen input and minimize conversion) should be selected empirically according to factors including, principally, aromatic content and nitrogen level.

An unexpected characteristic of the present process is that an improved process is obtained by designing for higher pressure. Conventionally, the objective in hydrotreater design is to minimise hydrogen consumption and this is generally achieved by operating at lower pressure. The principal objective in the present process, however, is to minimise light gas production and this is attained by high pressure, low temperature operation. When these factors are coupled with the preferred denitrogenation levels, noting that different temperatures are required at different pressure for a constant denitrogenation level, the final cracking process is significantly improved.

The hydrogen partial pressures used in the present hydrotreating step are generally in excess of 10,000 kPa (about 1,435 psig) and preferably above about 11,000 kPa (about 1,580 psig). The upper limit on the pressure is set mainly be equipment limitations which, in turn, are dictated by the cost of fabricating vessels for high pressures. In most cases, the total system pressure in the hydrotreating step will not exceed about 30,000 kPa (about 4,335 psig) and in most cases will be below about 20,000 kPa (about 2,900 psig). The use of higher hydrogen partial pressures tends to increase aromatics saturation and therefore is preferred because a higher level of saturation improves the cracking performance. However, the use of higher pressures will lead to increased hydrogen consumption with consequent higher costs and heavier demands on the hydrogen plant. Also, saturation beyond a certain level produces decreasing benefit since at these higher pressures relatively less hydrogen goes into saturation of polynuclear aromatics. Thus, a balance may need to be struck between attainment of highest process objectives and the benefits conferred by this.

In general, pressures between about 11,000 and 15,000 kPa (about 1435–2160 psig) will give the optimum benefit in the process as a whole with pressures of about 12000 kPa giving particular benefit.

The temperature is to be selected in part according to the hydrogen pressure used because higher temperatures may be tolerated at the higher hydrogen partial pressures which tend to inhibit catalyst aging. However, the thermodynamics of the desired aromatics saturation process—which is exothermic—provide a strong incentive for maintaining the temperature at as low a level as possible, consistent with achieving a severity high enough to achieve the degree of desulfurization which is actually desired. Because the use of higher pressures does not favor desulfurization activity, the level of desulfurization achieved will be dependent on the severity of the hydrotreating step, as indicated in part by the temperature. Another factor relevant to the final choice of temperature is the conversion during the hydrotreating step. As mentioned above, one objective is to minimize conversion to naphtha and dry gas because this represents a loss of valuable hydrogen to the cracking process where its presence can produce the greatest improvement. A certain level of conversion is, however, inevitable and is also necessary if desulfurization is to be achieved. The temperature used, therefore, will depend upon the characteristics of the feed (especially its cracking characteristics, degree of unsaturation and sulfur content) as well as catalyst characteristics (especially its aging rate and the balance of its cracking/hydrogenation activities).

In terms of numerical values, the temperature of the hydrotreating step will be between 345° and 455° C. (about 650° and 850° F.), preferably between 365° and 455° C. (about 690° and 850° F.), with the lower figure being applicable to the start-of-cycle (SOC) temperature. The preferred upper temperature limit is about 410° C. (about 770° F.) for the end of the cycle (EOC), preferably 400° C. (750° F.) after which catalyst regeneration is required. The actual end of cycle temperature will, however, depend upon the characteristics of the feed and the catalyst, especially its hydrogenation activity, since the run should be terminated when the saturation of the aromatics in the feed reaches an unacceptably low level by reason of the increased temperature. (Temperatures referred to are average catalyst bed temperatures, entire bed averaged axially, edge effects excluded).

The aging rate of the catalyst and the concomitant necessity to increase processing temperature as the cycle progresses is therefore a factor in the selection of temperature at any given time in the cycle. The aging rate, in turn, will be dependent on severity and hydrogen partial pressure. Severity, in turn will depend upon space velocity. Because the present process seeks to attain a high degree of aromatics saturation with denitrogenation as only a secondary objective, lower space velocities are desired at the lower temperatures used to favor the exothermic saturation reactions. Thus, in the present process, space velocity (LHSV) will be generally below 2 $hr^{-1}$, more generally in the range 0.5–1.5 $hr^{-1}$, with optimum values of about 1 $hr^{-1}$. In this respect, the present process represents a departure from prior FCC feed by hydrotreating practice which used relatively high space velocities of about 2 $hr^{-1}$ (LHSV) for desulfurization as the main objective. At these severities, desulufization will be sufficient to meet FCC $SO_x$ emission restrictions, equivalent to about 85% desulfurization of a feed with about 1 to 2 weight percent sulfur; in most cases, desulfurization will be at least 95% with nitrogen removal at 60–80%. Cycle durations of 1 to 2 years are envisaged at these severities, particularly if the preferred mode of operation at temperatures entirely below about 390° C. (about 730° F.) are employed.

The hydrotreating catalyst used may be conventional in type, comprising an acidic or non-acidic support, e.g. silica, alumina, silica-alumina or a crystalline aluminosilicate, preferably a large pore zeolite such as natural faujasite, zeolite X, zeolite Y or a composite of these materials such as zeolite X in an amorphous silica or silica-alumina matrix, together with a hydrogenation component which is typically a transition metal or metals, usually a base metal of Groups VA, VIA or VIIIA of the Periodic Table (IUPAC Table). In order to maintain conversion at a low level during the hydrotreating step, a low acidity support should be used. Base metals are usually preferred for the hydrogenation component because of their low cost and resistance to poisoning by contaminants but noble metals such as platinum or palladium could be used. Preferred base metals are vanadium, chromium, cobalt, nickel, molybdenum and tungsten; combinations of metals such as cobalt-molybdenum, nickel-cobalt, nickel-molybenum may be used to advantage. If the feed to the hydrotreater contains significant quantities of nitrogen as a contaminant, it will generally be preferred to avoid the use of cobalt because the catalytic activity of this metal is inhibited by nitrogen but other metals and combinations, e.g. Ni-Mo, may be used.

The effluent from the hydrotreating step is then passed to the catalytic cracking step. The catalytic cracking is conventional in type and may be a fluid catalytic cracking (FCC) operation or a gravitating moving bed operation, e.g TCC or Houdriflow. Cracking conditions are selected according to the characteristics of the cracking feed from the hydrotreater together when any recycle and, of course, according to the desired products, product distribution and the characteristics of the catalyst and of the unit. The hydrotreating of the feed in the manner described above provides a cracking feed of improved crackability and with reduced contaminant level. Because the use of high hydrogen pressures tends to saturate the feed aromatics to a greater extent, the cracking proceeds more readily to cracking products which are lower in molecular weight and with a relatively higher hydrogen content than would be obtained with the use of low to moderate hydrotreating pressures. The cracked products include significantly higher levels of high octane gasoline. By contrast, mild hydrotreating of the feed using lower pressures tends to produce cracked products with a higher proportion of low cetane distillate because of the higher aromatic content of the feed. Also mild hydrotreating conditions may lead to production of an olefinic gasoline which, although high in octane, may be considered undesirable by regulatory anthorities because of its asserted effects on the environment.

EXAMPLE 1

(Cases A–K)

The effects of hydrotreating FCC feed under different conditions were evaluated as described below.

A base feed of California/Alaskan (88:12) crude origin gas oils (mixed vacuum gas oil, coker gas oil) was prepared. Compositions of the feeds are shown in Table 1 below.

TABLE 1

| Feed Composition | Base Feed |
|---|---|
| Feed Components, Vol % | |
| Atmospheric Gas Oil | — |
| Vacuum Gas Oil (527° C. EP) | 78 |
| Coker Gas Oils | 22 |
| Gravity, °API | 16.8 |
| Sulfur, wt. pct. | 1.28 |
| Nitrogen, ppmw | 5100 |
| Basic Nitrogen, ppmw | 1900 |
| Ni/V, ppmw | 1.5/2.4 |
| CCR, wt. pct. | 0.9 |
| 345° C.+ Aromatics, wt. pct. | 68.0 |
| Distillation, Wt. Pct. | |
| 250° C.− | 4.8 |
| 250°–345° C. | 15.3 |
| 345° C.+ | 79.9 |

The feed was hydrotreated under varying conditions using a commercial Ni-Mo/$Al_2O_3$ (3 pct Ni, 18 pct Mo) hydrotreating catalyst. The hydrotreating conditions used are given in Table 2 below.

TABLE 2

| Hydrotreating Conditions for FCC Feed Preparation | | | | | | | |
|---|---|---|---|---|---|---|---|
| Case | DOS (1) | Pressure, kPa (psia) | Feed | LHSV | Average Reactor Temp °C. (°F.) | De-N Wt. Pct. (2) Total | Basic |
| A | 8 | 12065 (1750) | Base | 0.9 | 365 (690) | 53 | 56 |
| B | 15 | 12065 (1750) | Base | 2.2 | 400 (752) | 61 | 68 |
| C | 25 | 8650 (1240) | Base | 1.0 | 384 (723) | 61 | 68 |
| D | 44 | 8650 (1240) | Base | 1.8 | 411 (772) | 65 | 77 |
| F | 36 | 12065 (1750) | Base | 0.5 | 377 (710) | 75 | 81 |
| G | 41 | 12065 (1750) | Base | 1.0 | 401 (753) | 80 | 89 |
| H | 13 | 12065 (1750) | Base | 1.5 | 363 (685) | 37 | 36 |
| I | 29 | 8650 (1240) | Base | 1.0 | 374 (706) | 45 | 50 |
| J | 46 | 8650 (1240) | Base | 1.0 | 421 (790) | 78 | 94 |
| L | 31 | 8650 (1240) | Base | 2.4 | 418 (784) | 49 | 48 |

Notes:
(1) Days on stream
(2) 250° C.+ (480° F.+) product relative to feed

Cases A and B were designed to simulate start- and end-of-cycle hydrotreating performance at 1750 psia hydrogen pressure and 60% denitrogenation. Cases C and D were designed for this same denitrogenation level, but at 1240 psia hydrogen. Some unavoidable variation in denitrogenation was observed. Several other cases (F-K) examined various denitrogenation severities at both pressure levels. Case L reflects hydrotreater operation at reduced hydrogen circulation at 1240 psia hydrogen.

Each of the hydrotreater products was distilled to nominally 250° C. (480° F.) to produce the FCC feed.

The properties of each hydrotreated FCC feed are detailed in Table 3 below.

TABLE 3

| | A | B | C | D | E | F | G | H | I | J | K | L | E-1 | K-1 |
|---|---|---|---|---|---|---|---|---|---|---|---|---|---|---|
| Gravity, °API | 21.8 | 21.7 | 21.4 | 21.4 | 21.3 | 21.6 | 22.5 | 20.1 | 21.6 | 22.0 | 21.8 | 20.2 | 23.3 | 20.6 |
| Specific (15° C., 60° F.) | 0.9228 | 0.9237 | 0.9254 | 0.9253 | 0.9257 | 0.9241 | 0.9186 | 0.9335 | 0.9249 | 0.9219 | 0.9230 | 0.9326 | 0.9139 | 0.9305 |
| Specific (70° C.) g/cc | 0.8857 | 0.8880 | 0.8887 | 0.8887 | 0.8896 | 0.8880 | 0.8825 | 0.8964 | 0.8941 | 0.8852 | 0.8870 | 0.896 | 0.8775 | 0.8918 |
| Pour Point, °C. | 2 | 4 | 13 | 4 | 13 | 7 | 4 | 13 | 7 | 4 | 13 | 7 | −4 | 13 |
| KV 100° C. cs | 5.687 | 5.819 | 5.595 | 5.005 | 6.424 | 7.004 | 5.496 | 7.239 | 6.676 | 4.165 | 6.190 | 5.348 | 4.288 | 9.602 |
| Aniline Point °C. | 69.7 | 71 | 69.7 | 67.2 | 68.6 | 76.1 | 71 | 68.3 | 68.8 | 68.8 | 72.7 | 64.2 | 69.7 | 7.7 |
| Molecular Weight | 315 | 322 | 337 | 312 | 331 | 333 | 327 | 328 | 348 | 307 | 331 | 322 | 300 | 369 |
| Refractive Index (70° C.) | 1.48960 | 1.49159 | 1.49302 | 1.4955 | 1.4901 | 1.4898 | 1.4876 | 1.49676 | 1.4951 | 1.4953 | 1.4896 | 1.5010 | 1.4843 | 1.4945 |
| Hydrogen, Wt pct | 12.55 | 12.42 | 12.41 | 12.43 | 12.56 | 12.74 | 12.86 | 12.37 | 12.44 | 12.32 | 12.83 | 12.09 | 12.75 | 12.54 |
| Sulfur, Wt pct | 0.120 | 0.072 | 0.054 | 0.05 | 0.105 | 0.062 | 0.024 | 0.210 | 0.116 | 0.006 | 0.050 | 0.120 | 0.12 | 0.07 |
| Nitrogen, ppmw | 2400 | 2000 | 2000 | 1800 | 2200 | 1300 | 1000 | 3200 | 2800 | 1100 | 1500 | 2600 | 1900 | 1800 |
| Basic N, ppmw | 853 | 625 | 619 | 447 | 719 | 369 | 221 | 1243 | 972 | 121 | 438 | 999 | 672 | 467 |
| Ni, ppmw | ND | ND | 0.20 | 0.25 | ND | 0.4 | ND | 0.4 | ND | 0.2 | 0.45 | ND | 0.7 | 0.85 |
| V, ppmw | 0.24 | 0.48 | 0.24 | 0.28 | 0.44 | 0.28 | 0.12 | 0.6 | 0.28 | ND | 0.12 | 0.28 | 0.12 | 0.12 |
| Fe, ppmw | 0.45 | 0.90 | 0.10 | 0.85 | 0.35 | 0.45 | 0.06 | 0.75 | 0.25 | 0.15 | 0.40 | 0.70 | 0.5 | 0.65 |
| OCR, wt pct | 0.14 | 0.17 | 0.13 | 0.20 | 0.12 | 0.14 | 0.11 | 0.22 | 0.20 | 0.15 | 0.13 | 0.31 | 0.13 | 0.16 |
| Bromine No. | 3.6 | 3.4 | 3.3 | 3.9 | 3.0 | 2.8 | 3.5 | 4.6 | 4.4 | 5.3 | 4.4 | 6.1 | 4.5 | 5.8 |
| $C_A$, %, NMR | 19 | 19 | 21 | 25 | 19 | 18 | 18 | 20 | 21 | 25 | 18 | 24 | 19 | 18 |
| Distillation (D1160) °F.(°C.) | | | | | | | | | | | | | | |
| 1 | 397(203) | 531(277) | 474(246) | 483(251) | 540(282) | 534(279) | 518(270) | 525(274) | 498(2559 | 411(211) | 545(285) | 482(250) | 475(246) | 623(328) |
| 10 | 567(297) | 607(319) | 576(302) | 569(298) | 617(325) | 632(333) | 595(313) | 618(326) | 592(311) | 580(304) | 620(327) | 569(298) | 530(277) | 716(380) |
| 30 | 686(363) | 694(368) | 682(361) | 672(356) | 699(371) | 698(370) | 675(357) | 706(374) | 687(364) | 647(342) | 702(372) | 675(357) | 622(328) | 755(402) |
| 50 | 757(403) | 763(406) | 753(401) | 741(394) | 769(409) | 765(407) | 742(394) | 778(414) | 756(402) | 713(378) | 769(409) | 745(396) | 719(382) | 801(427) |
| 70 | 827(412) | 829(443) | 819(437) | 812(433) | 834(446) | 828(442) | 810(432) | 841(449) | 818(437) | 782(417) | 829(443) | 814(434) | 801(427) | 851(455) |
| 90 | 917(492) | 911(488) | 902(483) | 902(483) | 924(496) | 922(494) | 905(485) | 917(492) | 886(474) | 879(471) | 914(490) | 911(488) | 891(477) | 928(498) |
| 95 | 950(510) | 951(511) | 940(504) | 948(509) | 971(522) | 969(521) | 948(509) | 952(511) | 925(496) | 929(498) | 954(512) | 957(514) | 922(494) | 964(518) |
| EP | 951(511) | 967(519) | 992(533) | 995(535) | 978(526) | 1004(540) | 997(536) | 966(519) | 960(516) | 977(525) | 961(516) | 994(534) | 978(526) | 990(532) |

These data show a wide range of hydrotreated FCC feed properties at both hydrotreating pressures. At the same denitrogenation severity, the higher pressure hydrotreating cases gave significantly more aromatics saturation, particularly at high denitrogenation. Some variation in the amount of 480°-650° F. in the feed was observed (particularly in Case J); however, for the most part, the variation was apparently caused by laboratory distillation differences, rather than actual yield difference caused by hydrotreating severity or raw feed differences.

The hydrotreated feeds were catalytically cracked in an FCC pilot plant having a capacity of 80 l. day$^{-1}$ (0.5 BPD) using an equilibrium cracking catalyst having the properties given in Table 4 below.

TABLE 4

| FCC Catalyst Properties | |
|---|---|
| Density, g/cc | |
| Packed | 0.91 |
| Loose | 0.80 |
| Real | 2.78 |
| Particle | 1.31 |
| Pore Volume, cc/g | 0.41 |
| Surface Area, $m^2/g$ | 97 |
| Composition | |
| $Al_2O_3$, wt. pct. | 46.4 |
| $SiO_2$, wt. pct. | 42.0 |
| $Re_2O_3$, wt. pct. | 2.4 |
| Ni, ppmw | 390 |
| V, ppmw | 805 |
| Fe, ppmw | 0.6 |
| Cu, ppmw | 54 |
| Sb, ppmw | 1.0 |
| FAI Test, Clean Burned (1) | 174-6933 |
| Conversion, vol pct. | 61.7 |
| Gasoline, vol pct. | 54.9 |
| $C_4$, vol pct. | 11.9 |
| Dry Gas, wt pct. | 3.3 |
| Coke, wt. pct. | 0.87 |
| $C_{LETGO}$, wt. pct. | 0.39 |
| Hydrogen Factor, mol/mol | 54 |

Note:
(1) Fluid Activity Index

In the cracking tests, two to eight material balances were taken for each feed. Catalyst-to-oil (C/O) ratio was varied from about 5 to about 12 weight catalyst/-weight oil. Riser top temperature was held constant at nominally 530° C. (990° F.) throughout the study, although the effect of riser top temperature was evaluated with two additional balances at 520° C. (968° F.) and 541° C. (1006° F.) with the Case A feed. All other variables including oil-to-riser temperature were held essentially constant.

Spent and regenerated catalyst samples were taken twice during each four hour material balance. Equilibrium catalyst was added liberally to maintain catalyst activity. In addition, three complete catalyst changeouts were performed during the study. As a result, FAI variation over the entire study was less than 5 numbers. The results are presented in summary form in the accompanying drawings and the following discussion.

The various parameters examined in this study, including: denitrogenation severity, hydrotreating pressure, FCC feed cut point, FCC riser top temperature and added light atmospheric gas oil in the feed, are discussed below.

DENITROGENATION SEVERITY

In order to establish the effect of denitrogenation severity, several feed cases were grouped together as follows:

| Denitrogenation, % | Cases |
|---|---|
| 0 | Raw |
| 40-50 | H, I, L |
| 55-65 | A-D |
| 75-80 | F, G |

Figure 1B:
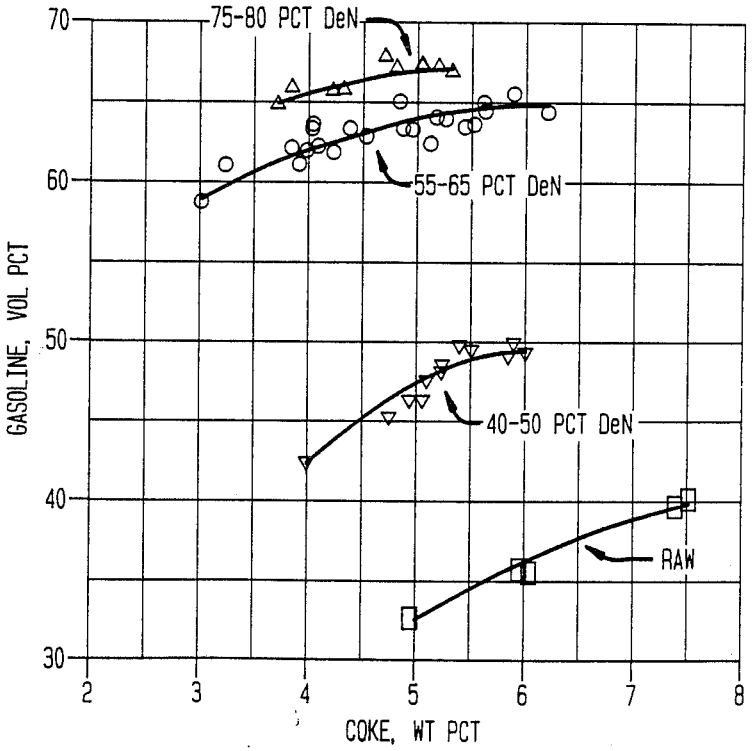
FIG. 1B is a graph relating the effect of hydrotreating severity on gasoline yield from cracking.

On a constant coke basis, an increase in hydrotreater severity yields higher conversion and gasoline yields, as shown in FIGS. 1A and 1B which show the effect of denitrogenation selectivity on coke selectivity (FIG. 1A) and gasoline selectivity (FIG. 1B) in the FCC process. The increase in gasoline yield at 5.5% coke is about 18 vol % at 40-50% denitrogenation versus raw and up to 32 vol % at 75-80% denitrogenation. This increase in gasoline yield at constant coke is accompanied by corresponding decreases in gases, light cycle oil, and main column bottoms. Although minor amounts of scatter are observed, the FCC yields are mainly a function of FCC conversion, independent of hydrotreating severity (FIGS. 1-7), indicating that denitrogenation is not, in itself, the most significant yield determining factor in the process.

Hydrotreating serves the dual purpose of removing nitrogen compounds, which act as temporary catalyst poisons, and saturating aromatics (including many containing nitrogen compounds) which act as coke precursors. Hydrotreating also reduced the CCR from 0.8% in the raw feeds to 0.1-0.2%. The removal of CCR reduces the "additive" coke formed in the FCC, that is, the coke that is deposited on catalyst directly from CCR in the feed. Additive coke, defined as 85% of the CCR, does not, however, make a major contribution to the overall coke make nor does it explain why the coke yield is much higher for the raw feeds than the hydrotreated feeds. The removal of coke precursors, by saturating aromatics and removing nitrogen, is probably the more significant reason for the reduced coke make (or conversely, greater conversion at constant coke). In general, increased denitrogenation is accompanied by increased aromatics saturation and, thus, at higher denitrogenation the overall coke make is less, despite similar additive coke yields.

Figure 2:
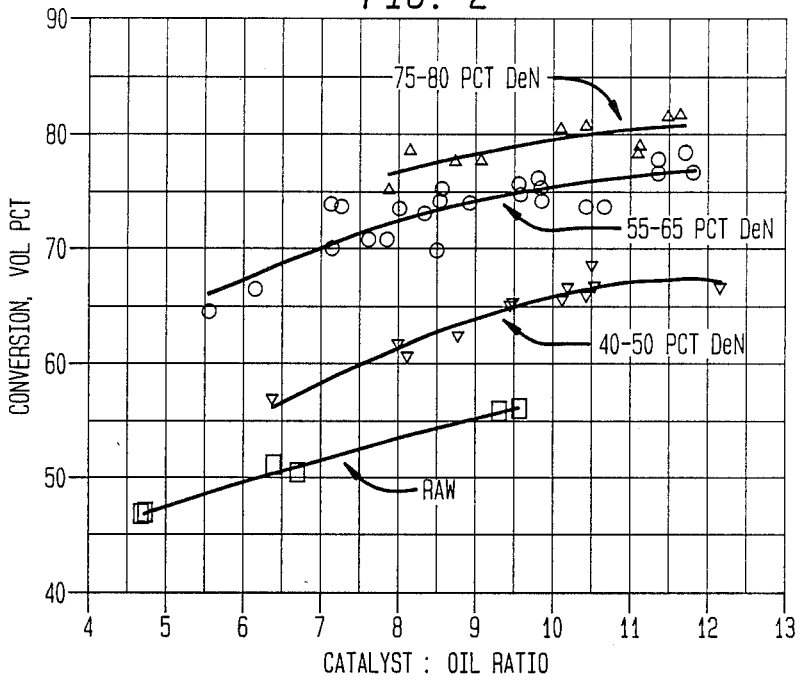
FIG. 2 is a graph relating the catalyst:oil ratio during cracking against the resulting conversion.
Figure 4:
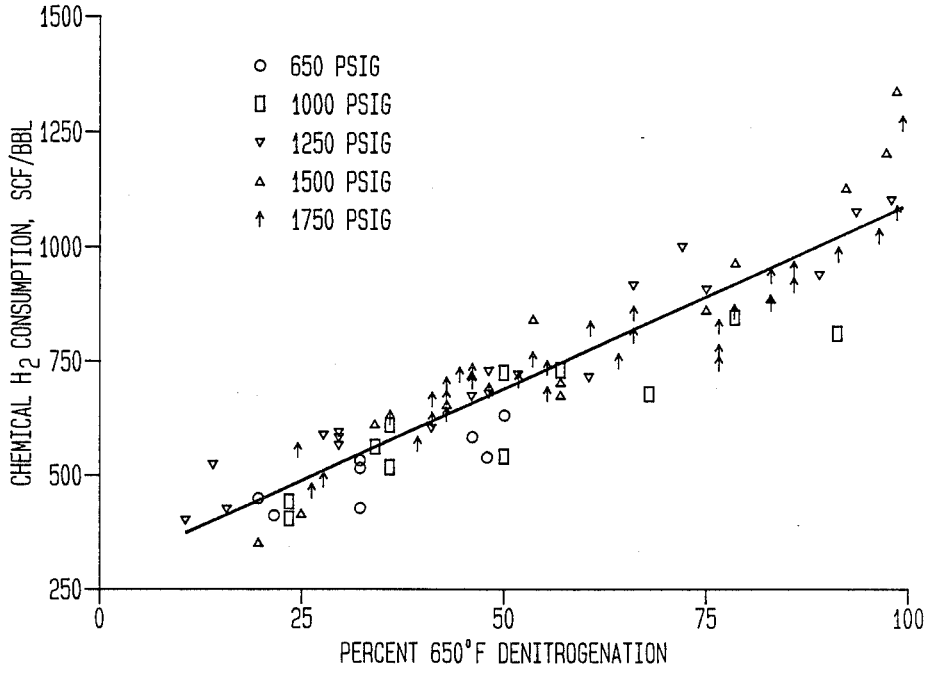
FIG. 4 is a graph relating hydrogen consumption to hydrotreating severity at different pressures.

While nitrogen-containing compounds can be considered as coke precursors (most are contained in aromatic rings), the major effect of nitrogen, reducing catalyst activity, can be seen more clearly in FIG. 2 which is a plot of FCC conversion against the catalyst:oil ratio at differing denitrogenation levels. As more nitrogen is removed by hydrotreating, less active sites on the cracking catalyst are poisoned by basic nitrogen, thus, allowing greater conversion at a given catalyst:oil ratio.

Hydrotreating severity obviously has a large effect on conversion at constant coke, but surprisingly FCC yields can be described solely as a function of FCC conversion, independent of hydrotreating severity except at conversions approaching 100-$C_A$, where $C_A$ is the aromatic carbon in the feed when the gasoline yield drops off due to overcracking. Case J, with high denitrogenation but relatively little aromatics saturation at the lower hydrotreating pressure, best exhibits this trend.

HYDROTREATING PRESSURE EFFECT

Figure 3A:
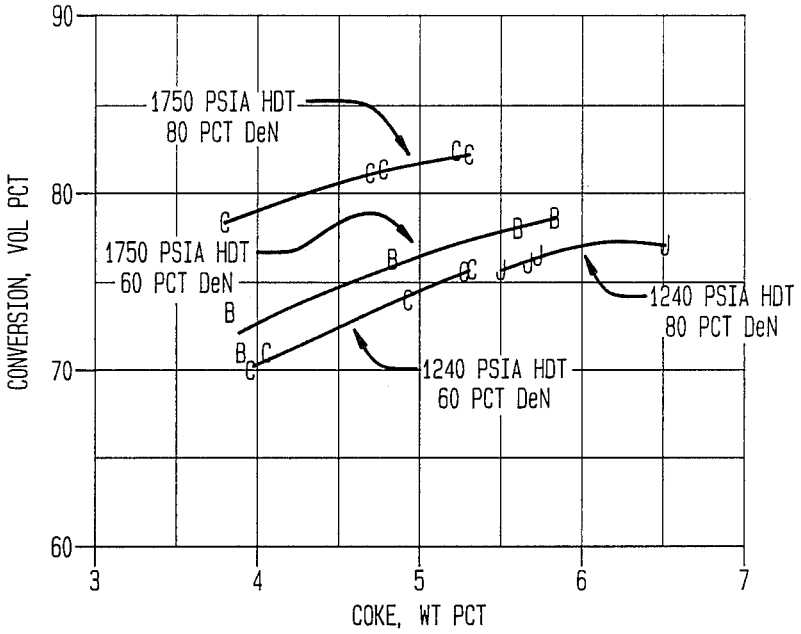
FIG. 3A is a graph relating the coke make during cracking to conversion during cracking at different hydrotreating pressures and denitogenation levels.
Figure 3B:
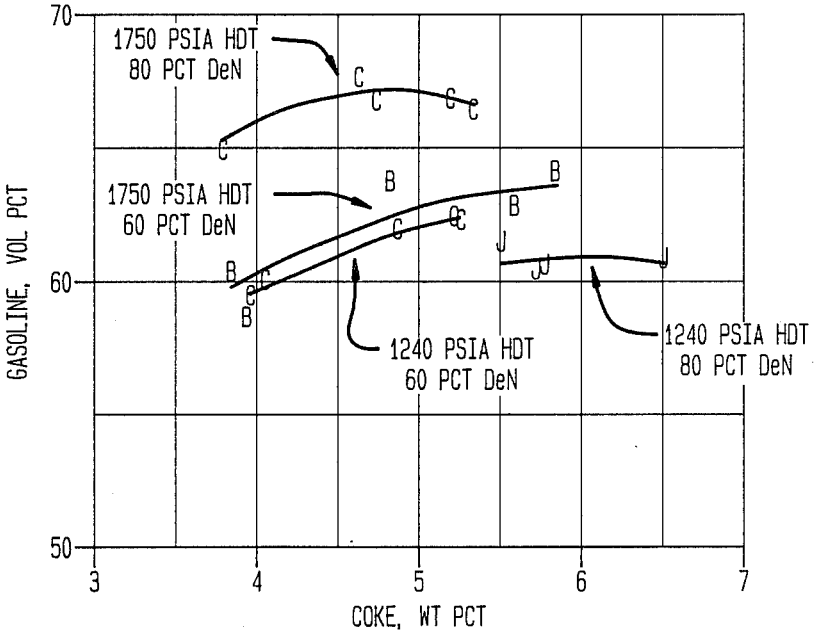
FIG. 3B is a graph relating the coke make during cracking to gasoline yield from cracking at different hydrotreating pressures and denitrogenation levels.

Although high and low pressure cases are grouped together in the above section, diferences in FCC performance for feeds hydrotreated to the same nitrogen level, but at different hydrotreater pressures were noted. The difference can best be seen when comparing Cases B and C at 60% denitrogenation and Cases G and J at 80% denitrogenation. Case B and G are hydrotreated at 1750 psia $H_2$, Cases C and J at 1250 psia $H_2$. At constant coke, the differences between Cases B and C indicate a relatively small effect of pressure, as shown in FIGS. 3A and 3B which show the coke and gasoline selectivities at differing pressures and hydrotreating severities.

These studies show that hydrotreating the FCC feed greatly increases the FCC conversion and gasoline yield at constant coke. In general, the benefits of hydrotreating increase with increasing hydrotreater severity, i.e. denitrogenation and at higher denitrogenation severity, the benefits of high pressure operation of the hydrotreater are most significant in terms of superior conversion and gasoline yield.

At modest denitrogenation levels, the degree of aromatics saturation is nearly the same ($C_A$ is 19% for Case B; 21% for Case C) but at higher hydrotreating pressures, FCC conversion and gasoline selectivity increase notably: Case G at 80% denitrogenation shows an increase in FCC conversion and gasoline selectivity at constant coke relative to the 60% denitrogenation cases. Case J at the lower hydrotreating pressure, conversely shows a decrease in conversion and gasoline selectivity for the same increase in denitrogenation severity. This phenomenon can easily be explained by the increase in aromatics content in the Case J feed ($C_A$=26%) at the high HDT temperature required to achieve 80% denitrogenation at 1 LHSV. Case G, on the other hand, showed additional aromatics saturation ($C_A$=18%) at its milder hydrotreating temperature. Case J also shows a slight shift in yields at constant conversion relative to the other cases, probably because conversion for Case J approaches 100-$C_A$. The difference in aromatics saturation, and subsequently, in FCC gasoline selectivity conclusively establishes higher pressure, and higher severity, hydrotreating as the preferred conditions.

EXAMPLE 2

The base feed was subjected to hydrotreating and catalytic cracking as described in Example 1 at three temperature ranges:

345°-365° C. to simulate SOC

390° to simulate mid cycle

410° C. to simulate EOC

Space velocity was varied at each combination of temperature and pressure to cover the range of denitrogenation projected for the design. Once-through hydrogen was utilized with most data collected at 535 n.l.l.$^{-1}$ (3000 SCF/Bbl) hydrogen circulation.

Three different small scale (100cc catalyst volume) fixed bed down-flow isothermal reactors were used in this study. The catalyst used was the same as in Example 1, presulfided with 1.38% S SRGO at 2860 kPa (400 psig) and temperatures of 230° to 345° C. (450° to 650° F.). The results are discussed below.

The results showed that at SOC temperatures (345°-365° C.) the hydrotreating pressure has no significant effect on the yield of 345° C.+products from the cracker but that at the higher hydrotreating temperatures, higher operating pressures reduce conversion in the hydrotreating step. For example, at the EOC temperature of 410° C. and at 75% denitrogenation, an advantage of about 5 weight percent in the 345° C.+ yield is observed at the higher pressure of 12065 kPa (1750 psig) as compared to operation at 8650 kPa (1250 psig). This, in turn, causes higher cycle average yield of FCC feed as well as a higher quality FCC feed. Because the use of the higher hydrogen pressure tends to reduce hydrotreating conversion, severities in excess of 90% denitrogenation are needed at 12065 kPa before extensive hydrocracking occurs.

Below 80% denitrogenation, the 250° C.+ (480° F.+) yields were more sensitive to pressure than the 345° C.+ (650° F.) yields. At low SOC temperatures, there is no apparent effect of pressure, whereas at 390° (730° F.) and 410° C. (790° F.), the 250° C.+ (480° F+) yields remain greater than 90 wt percent at all reasonable severity levels but decrease significantly at lower pressure. The effect of operating pressure on light gas make was apparent even at 365° C. (690° F.) and becomes more pronounced as temperature was increased. At 410° C. (790° F.) and 75% HDN, more than twice as much light gas production was observed at 8720 kPa (1250 psig) than at 12065 kPa (1750 psig). This is inefficient use of hydrogen in the hydrotreater. Since overall hydrogen consumptions are only a weak function of operating pressure, less hydrogen is being utilized to upgrade the FCC feed at constant denitrogenation and the lower operating pressures. The lower quality 345° C.+ (650° F.+) hydrotreated product was also reflected in FCC performance as lower conversion and gasoline yield.

Incremental $C_5$-250° C. ($C_5$-480° F.) naphtha was not a function of operating pressure at 345° (650° F.) and 365° C. (690° F.) but was apparent at 390° C. (730° F.) and is significant at 410° C. (770° F.). This is caused by the ∓rolling down" of higher boiling hydrocarbons as conversion of 345° C.+ (650° F.+) increases with hydrotreating temperature, particularly at the lower pressures. At 12065 kPa (1750 psig) and 75% denitrogenation yield of $C_5$-250° C. ($C_5$-480° F.) remains essentially constant at 8-10 wt % as temperature increases from 345° C. to 410° C. (650° C. to 770° F.). Over this same temperature range, 8720 kPa (1250 psig) operation gives an increase from 8 to 16 wt % of $C_5$-250° C. ($C_5$-480° F.).

The yield of 250°-345° C. (480°-650° F.) distillate is less sensitive to pressure. No effect is seen at 345° C. (650° F.) and 365° C. (690° F.), and differences of only about 2 wt % yield are observed at 390° C. (735° F.) and 410° C. (770° F.). This means that the increasing spread in 345° C.+ (650° F.+) yields between the two pressures as temperature increases is realized mainly as 250° C.− (480° F.−) product. Thus, there is a direct loss of FCC feed regardless of whether 250° C.+ (480° F.+) or 345° C.+ (650° F.+) is sent to the cracker.

HYDROGEN CONSUMPTION

Hydrogen consumption was found to be a function of temperature as well as denitrogenation level except at 12065 kPa (1750 psig) where a temperature effect is not apparent, probably due to thermodynamic limitations in saturating aromatics at the lower pressure levels.

The composite curve for hydrogen consumption at all temperatures and pressures (FIG. 4) indicated 133 n.l.l.$^{-1}$ (750 SCF/Bbl) consumption at 60% hydrodenitrogenation and 153 n.l.l.$^{-1}$ (860 SCF/Bbl) at 75% hydrodenitrogenation. A rapid increase in consumption is observed above 90% hydrodenitrogenation where significant hydrocracking can occur.

We claim:

1. A process for hydrotreating and catalytically cracking a hydrocarbon feedstock having a paraffin content of less than 30 percent and an aromatic and naphthene content of at least 70 volume percent, a majority of which is aromatics in which the feedstock is hydrotreated at elevated temperature and pressure in the presence of hydrogen and a hydrotreating catalyst and the hydrotreated product is catalytically cracked to produce lower boiling cracked products, the hydrotreating being carried out under the following conditions:

pressure ($H_2$, partial): at least 10,000 kPa
temperature (Start-of-cycle): not more than 365° C.
and at a severity to achieve 65% to 80% denitrogenation, a desulfurization of at least 85% and not more than 20 vol. percent conversion.

2. A process according to claim 1 in which the denitrogenation is at least 75%.

3. A process according to claim 1 in which the hydrotreating pressure is at least 12,000 kPa.

4. A process according to claim 1 in which the hydrotreating temperature (End-of-cycle) is not more than 410° C.

* * * * *